US007832957B2

(12) United States Patent
Gelfand

(10) Patent No.: US 7,832,957 B2
(45) Date of Patent: Nov. 16, 2010

(54) REMOVABLE BARRICADE SYSTEM

(75) Inventor: Matthew A. Gelfand, Brentwood, TN (US)

(73) Assignee: Universal Safety Response, Inc., Franklin, TN (US)

( * ) Notice: Subject to any disclaimer, the term of this patent is extended or adjusted under 35 U.S.C. 154(b) by 0 days.

(21) Appl. No.: 11/525,478

(22) Filed: Sep. 22, 2006

(65) Prior Publication Data

US 2008/0073633 A1 Mar. 27, 2008

(51) Int. Cl.
*E01F 15/06* (2006.01)

(52) U.S. Cl. ..... 404/6; 49/9; 49/34; 256/1

(58) Field of Classification Search ..... 404/6, 404/10; 256/1, 23; 49/34, 9, 49; 405/302.7
See application file for complete search history.

(56) References Cited

U.S. PATENT DOCUMENTS

| | | | | | |
|---|---|---|---|---|---|
| 3,021,114 | A | | 2/1962 | O'Connell | |
| 3,845,804 | A | * | 11/1974 | Romberg | 160/328 |
| 3,847,425 | A | * | 11/1974 | Kirk | 292/247 |
| 4,124,196 | A | * | 11/1978 | Hipskind | 256/1 |
| 4,498,660 | A | * | 2/1985 | Brema et al. | 256/19 |
| 4,576,364 | A | * | 3/1986 | O'Fearna | 256/24 |
| 4,824,282 | A | * | 4/1989 | Waldecker | 404/6 |
| 5,050,846 | A | * | 9/1991 | Goodman et al. | 256/1 |
| 5,267,813 | A | * | 12/1993 | Neal | 405/72 |
| 5,394,927 | A | * | 3/1995 | Huebner | 160/327 |
| 5,460,353 | A | * | 10/1995 | Rittenhouse | 256/1 |
| 5,595,230 | A | * | 1/1997 | Guerra | 160/135 |
| 5,758,868 | A | * | 6/1998 | Shea | 256/12.5 |
| 5,875,597 | A | * | 3/1999 | Gingrich et al. | 52/239 |
| 5,961,242 | A | * | 10/1999 | Leone | 403/234 |
| 6,176,642 | B1 | * | 1/2001 | Hinterholzer | 404/10 |
| 6,367,781 | B1 | * | 4/2002 | Flynn et al. | 256/45 |
| 6,389,659 | B1 | * | 5/2002 | Jacobs | 24/573.09 |
| 6,558,075 | B2 | * | 5/2003 | Benedict et al. | 405/21 |
| 6,595,496 | B1 | * | 7/2003 | Langlie et al. | 256/1 |
| 6,646,563 | B1 | * | 11/2003 | Buckley et al. | 340/668 |
| 6,802,496 | B1 | * | 10/2004 | Preta | 256/65.04 |
| 7,384,211 | B2 | * | 6/2008 | Wong | 404/6 |

OTHER PUBLICATIONS

International Search Report, PCT/US07/20280, 24, Mar. 2008, 5 pages.
Written Opinion of the International Searching Authority, PCT/US07/20280, 24, Mar. 2008, 3 pages.

* cited by examiner

*Primary Examiner*—Gary S Hartmann

(57) ABSTRACT

A removable barricade system. The system having a first sleeve to be affixed to a first bollard, a second sleeve to be affixed to a second bollard, and a barricade attached to the first and second sleeves. The barricade blocks the area between the first and second bollards.

23 Claims, 6 Drawing Sheets

REMOVABLE BARRICADE SYSTEM

BACKGROUND

This invention relates to a removable barricade system, and more specifically to a covering and net that may be used in connection with a bollard preventing a person or vehicle from passing around the bollard.

SUMMARY OF THE DISCLOSURE

The present disclosure relates to a removable barricade system. In one aspect, the removable barricade system has a first sleeve to be affixed to a first bollard, a second sleeve to be affixed to a second bollard, and a barricade attached to the first and second sleeves, the barricade blocks the area between the first and second bollards.

DETAILED DESCRIPTION

Figure 1:
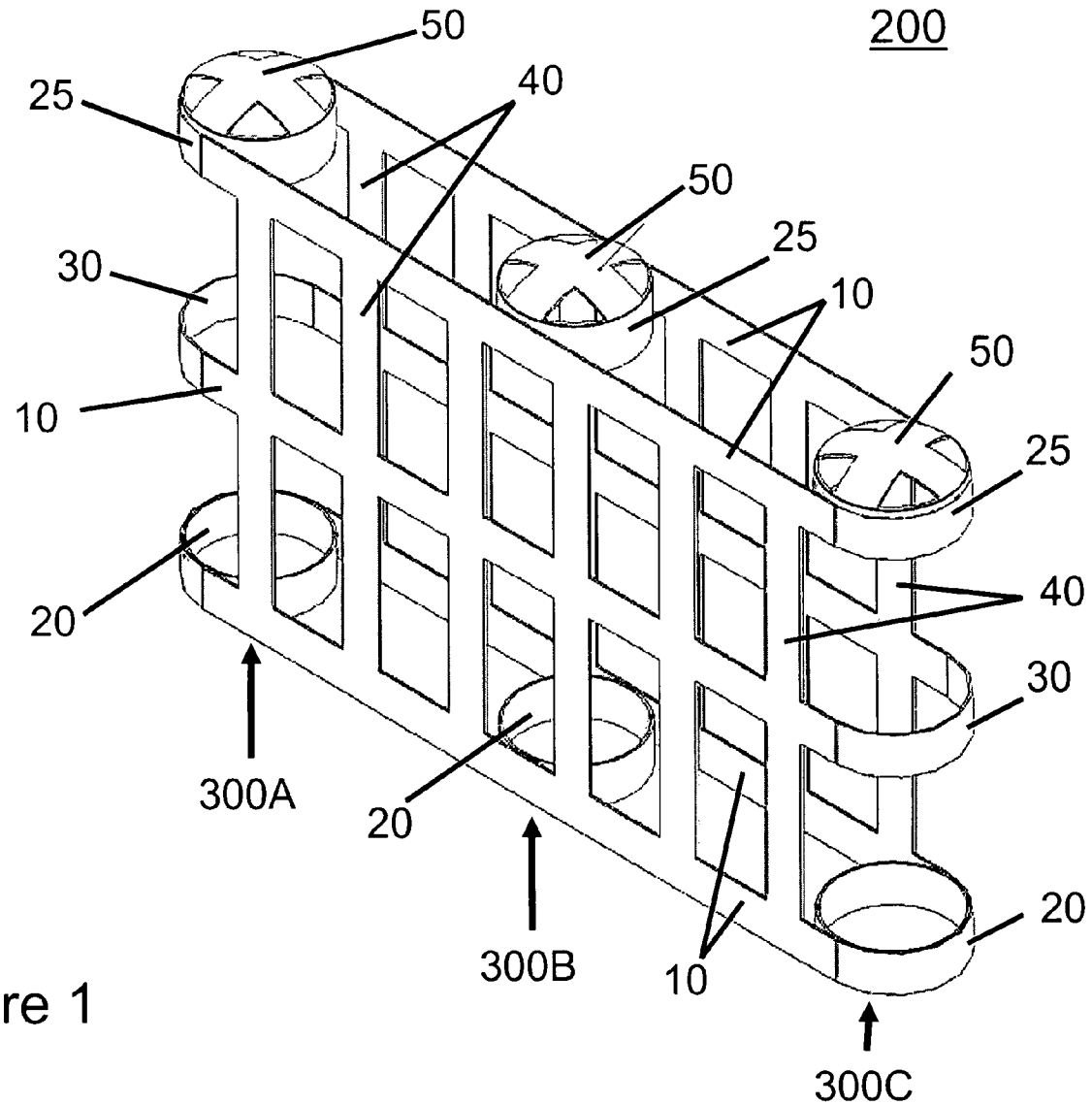
FIG. 1 is a perspective view which illustrates a removable barricade system with a net spanning the area between bollards according to one aspect of the system of the present disclosure.

Referring to the drawings, wherein like reference numerals represent identical or corresponding parts throughout the several views, and more particularly to FIG. 1, a general layout of an embodiment according to one aspect of the system of the present disclosure is shown.

A barricade is indicated generally by reference numeral 200 and may have horizontal members 10 and vertical members 40. Barricade 200 may include one or more sleeves 300A, 300B, and 300C.

In FIG. 1, barricade 200 is depicted prior to placement on bollards 100 (not shown). Sleeves 300-A and 300-C may include base loop 20, intermediary loop 30 and top loop 25. In an arrangement shown in FIG. 1, sleeve 300-B may include base loop 20 and top loop 25. Top cover 50 may be fitted to top loop 25.

In one aspect, sleeves 300 may be coupled to one or more horizontal members 10 and vertical members 40, using, for example, stitching and/or glue. In another aspect, sleeves 300 may include loops (not shown) through which horizontal members 10 and/or vertical members 40 may be threaded and movably arranged. It may be useful to arrange horizontal members 10 and/or vertical members 40, especially when bollards 100 are not spaced uniformly apart.

Vertical members 40 may be coupled to horizontal members 10 at some spacing interval, or vertical members 40 may include loops (not shown) through which horizontal members 10 are threaded, and vertical members 40 may be movably arranged along horizontal members 10. Similarly, in another aspect, one or more horizontal members 10 may include loops (not shown) and may be movably arranged along vertical members 40.

Figure 2:
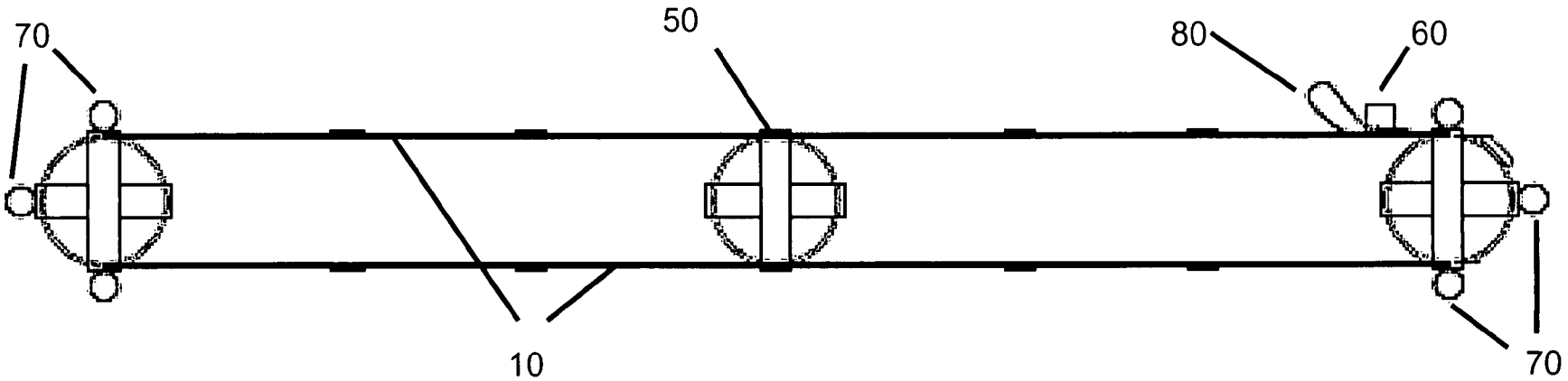
FIG. 2 is a top view which illustrates a removable barricade system with a net spanning the area between bollards according to one aspect of the system of the present disclosure.

FIG. 2 shows tensioning latch 60, net extension loop 70 and tensioning belt 80 attached to sleeves 300A and 300C. Tensioning latch 60 and tensioning belt 80 may be used to tension horizontal member 10. For example, a user may pull tensioning belt 80 and pull excess material of horizontal member 10 through tensioning latch 60 thereby taking up slack in horizontal member 10. It may be useful to tension horizontal members 10, especially when bollards 100 are not spaced uniformly apart.

In another aspect, tensioning latch 60 and tensioning belt 80 may act as an energy absorber or energy dissipater, providing tension on horizontal member 10 until a threshold force is applied to horizontal member 10, for example, during impact by a person or vehicle. Upon application of such threshold force, tensioning latch 60 may release at least a portion of tensioning belt 80 thereby absorbing and/or dissipating energy.

In another aspect, tensioning latch 60 may be used to more firmly secure the sleeves 300 to bollards 100.

Figure 3:
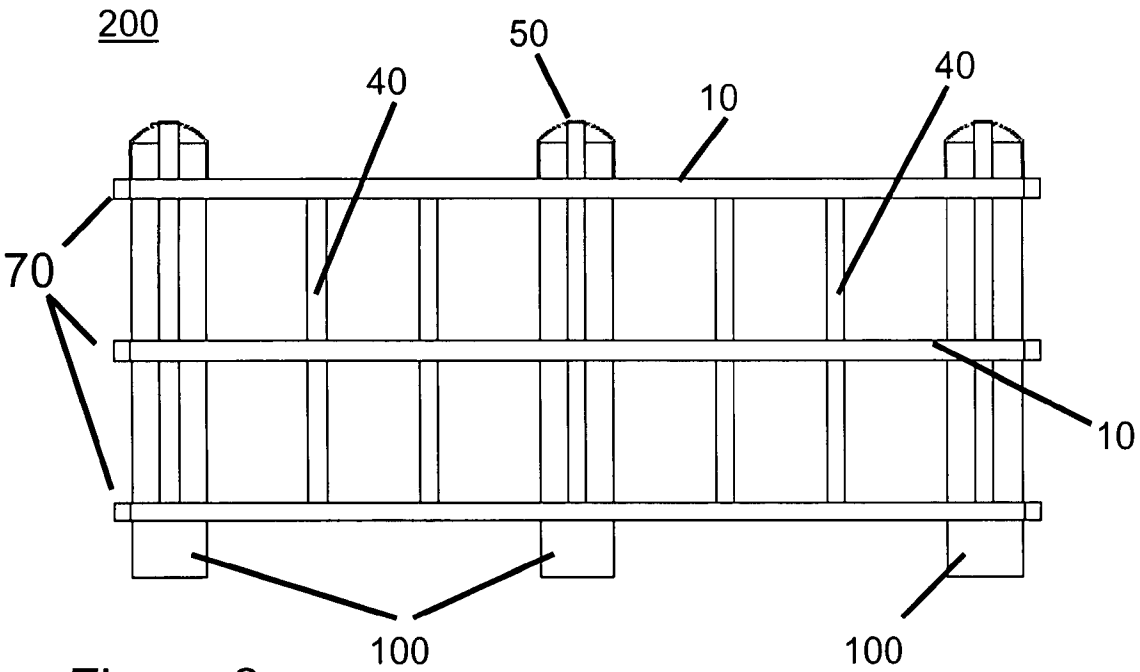
FIG. 3 is a front view which illustrates a removable barricade system with a net spanning the area between bollards according to one aspect of the system of the present disclosure.

FIG. 3, shows a front view of bollards 100 covered by barricade 200. Net extension loops 70 may be attached to sleeves 300 and may allow barricade 200 to be coupled to other barricades or anchor points (not shown).

Figure 4:
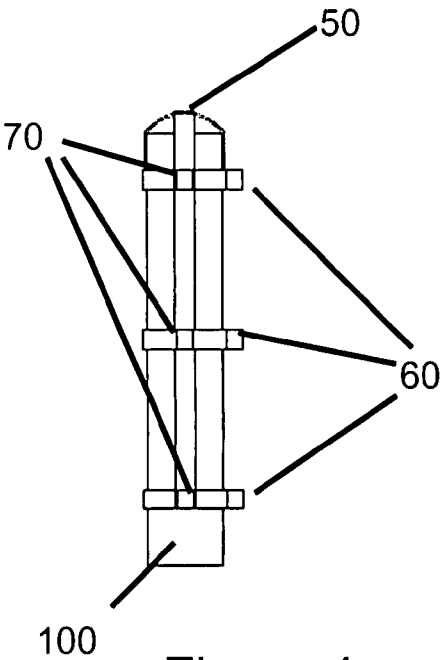
FIG. 4 is a side view which illustrates a removable barricade system with a net spanning the area between bollards according to one aspect of the system of the present disclosure.

As shown in FIG. 4, bollard 100 may be fitted with sleeve 300 including base loop 20, intermediary loop 30, and top loop 25. Sleeve top cover 50 may be attached to top loop 25 and may secure the position of top loop 25. In one aspect, tensioning latches 60 may be present for each horizontal member 10. Net extension loops 70 may be coupled to base loop 20, intermediary loop 30, and top loop 25.

Figure 5:
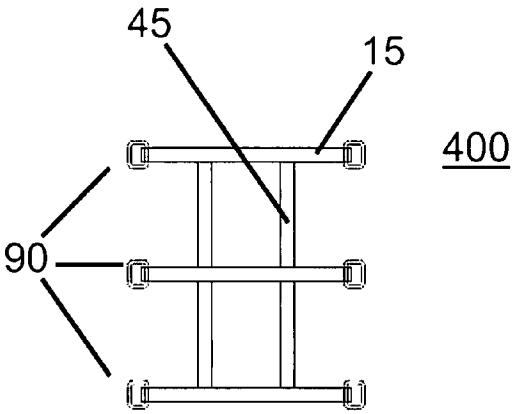
FIG. 5 is a front view of a removable connector according to one aspect of the system of the present disclosure.

FIG. 5 shows a front view of removable connector 400. Removable connector 400 may include one or more horizontal members 15 and one or more vertical members 45. Removable connector 400 also may include one or more linking members 90 which may be used to connect to one or more net extension loops 70.

Figure 6:
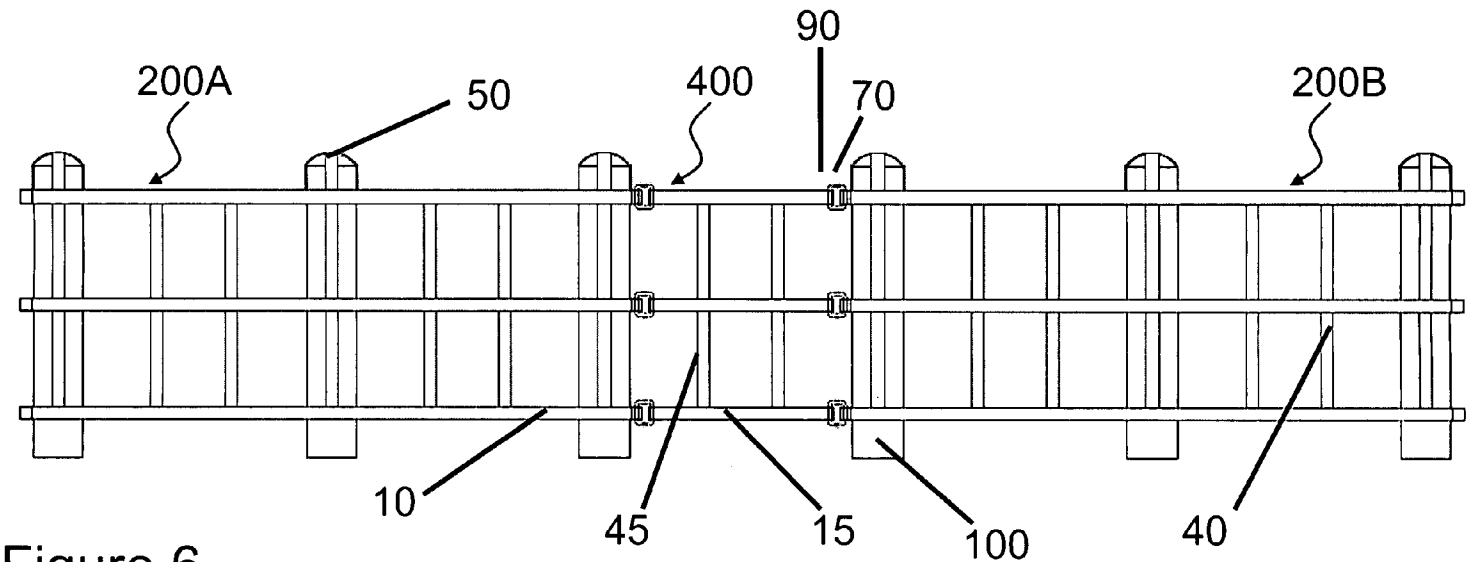
FIG. 6 is a front view which illustrates a removable connector joining two removable barricades according to one aspect of the system of the present disclosure.

As shown in FIG. 6, linking members 90 of removable connector 400 may be coupled to extension loops 70 of barricades 200A and 200B. Linking members 90 may be coupled to extension loops 90 using D-links or other joining or coupling devices.

Figure 7:
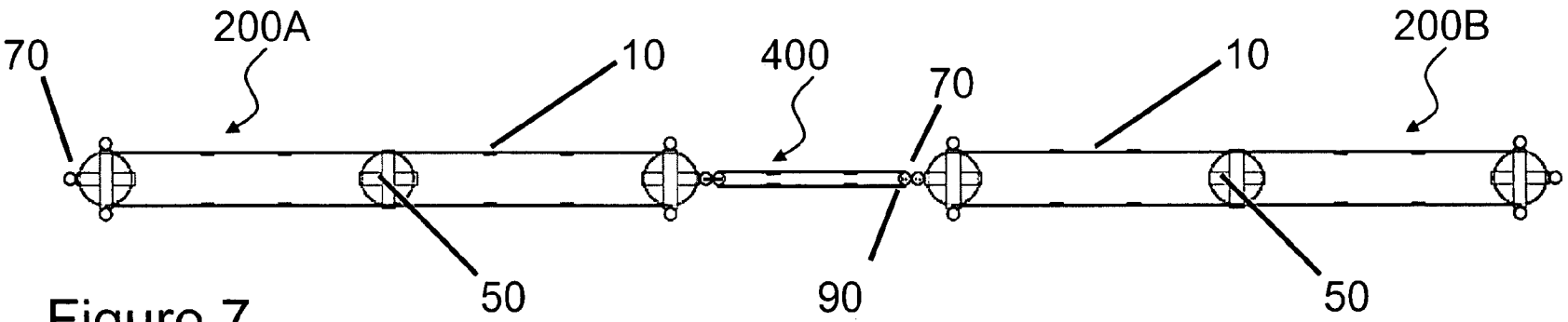
FIG. 7 is a top view which illustrates a removable connector joining two removable barricades according to one aspect of the system of the present disclosure.
Figure 8:
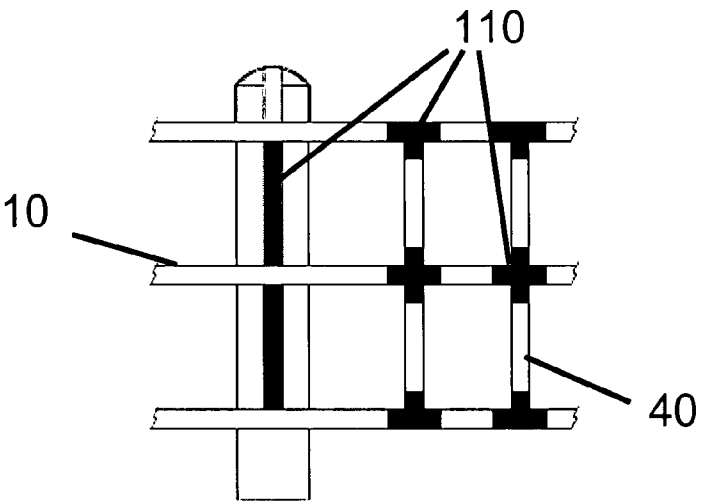
FIG. 8 is a front view of a portion of a removable barricade system with reflective material according to one aspect of the system of the present disclosure.

FIG. 7 is a top view of barricades 200A and 200B joined using removable connector 400. In FIG. 8, a side view of a portion of a removable barricade system is depicted with reflective material 110, for example, paint, tape, or stitching, covering portions of the vertical members 40 and horizontal members 10. Reflective material 110 may similarly be placed on removable connector 400 (not shown) and may improve visibility of the system and cover the seams between the vertical and horizontal members.

Figure 9:
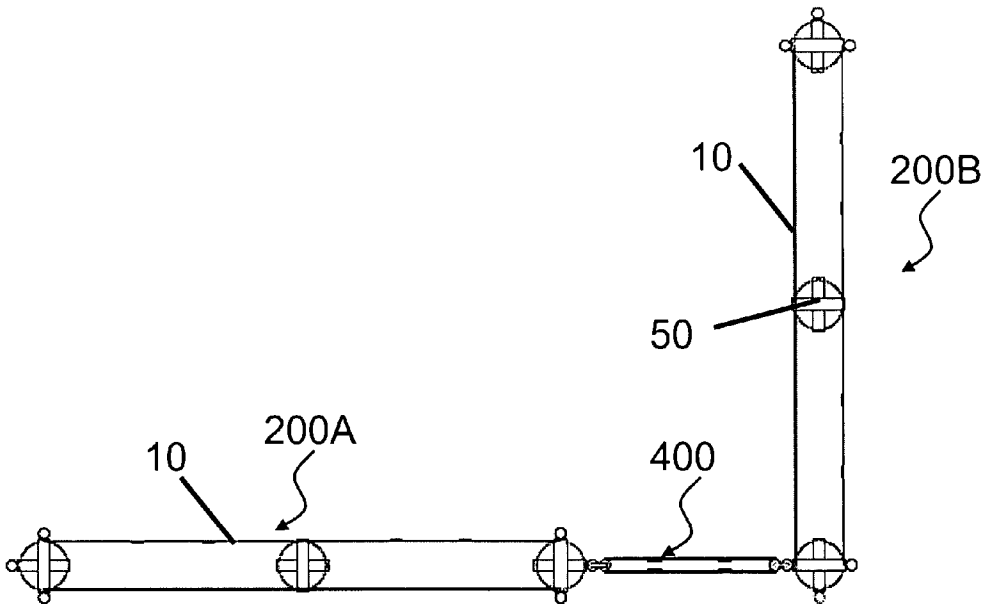
FIG. 9 is a top view which illustrates a removable connector joining two removable barricades positioned at right angles to one another according to one aspect of the system of the present disclosure.
Figure 10:
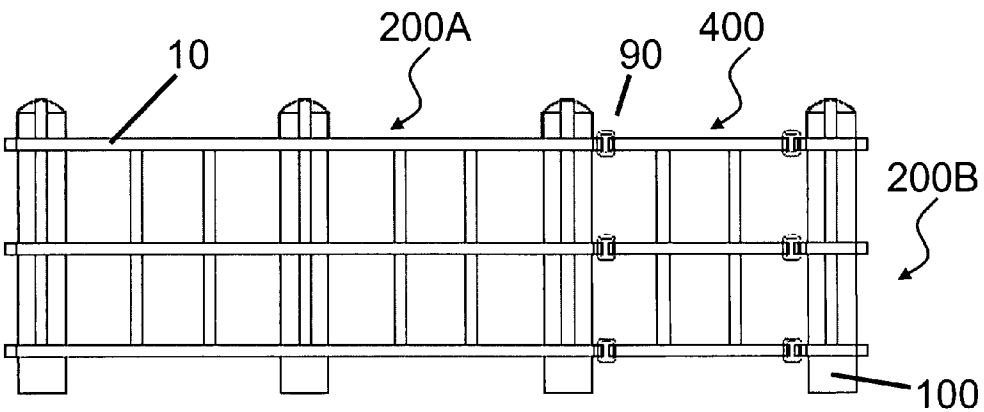
FIG. 10 is a front view which illustrates a removable connector joining two removable barricades positioned at right angles to one another according to one aspect of the system of the present disclosure.

FIG. 9 shows a top view of removable connector 400 joining barricades 200A and 200B, arranged at a right angle. FIG.

10 shows a front view of removable connector 400 joining barricades 200A and 200B, arranged at a right angle In another aspect of the system of the present disclosure, sleeve top covers 50 may be color coded for ease in orienting barricade 200 before placement over bollards 100.

In another aspect, two or more barricades 200 may be connected at tensioning latches 60.

Bollard 100 may be a pre-existing fixed bollard or a retractable or removable bollard and is usually anchored in a ground surface.

In another aspect, barricade 200 may be constructed of a durable mesh, such as a nylon cargo strapping net. In yet another aspect, barricade 200 may be formed of a solid structure, for example, concrete, wood, metal, or composite materials.

In another aspect barricade 200 may extend from the top of a series of bollards to the base of a series of bollards. Thus, the entire area between a pair of bollards 100 may be blocked by barricade 200.

Although illustrative embodiments have been described herein in detail, it should be noted and will be appreciated by those skilled in the art that numerous variations may be made within the scope of this invention without departing from the principle of this invention and without sacrificing its chief advantages.

Unless otherwise specifically stated, the terms and expressions have been used herein as terms of description and not terms of limitation. There is no intention to use the terms or expressions to exclude any equivalents of features shown and described or portions thereof and this invention should be defined in accordance with the claims that follow.

What is claimed is:

1. A removable barricade system for use with a first, second, and third bollard comprising:

a first sleeve affixed to the first bollard;

a second sleeve affixed to the second bollard;

a third sleeve affixed to the third bollard;

a barricade attached to the first, second, and third sleeves, the barricade including at least one substantially horizontal member, the substantially horizontal member forming a loop encircling the first, second, and third bollards; and an adjustable tensioning latch for tensioning the substantially horizontal member and gathering an excess portion of the substantially horizontal member provided a predetermined condition is met, wherein the barricade blocks an area between the first, second, and third bollards.

2. The removable barricade system of claim 1, wherein at least one of the sleeves has a top cover.

3. The removable barricade system of claim 2, wherein the top cover has a loop encompassing at least a portion of a horizontal member.

4. The removable barricade system of claim 1, wherein at least a portion of the barricade is a rigid structure.

5. The removable barricade system of claim 1, wherein at least a portion of the barricade is made of one of wood, metal, and composite material.

6. The removable barricade system of claim 1, wherein the barricade extends from the top to the bottom of the first and second bollards.

7. The removable barricade system of claim 1, wherein at least one of the first and second sleeves has one or more attached extension loops.

8. The removable barricade system of claim 1, wherein at least a portion of the barricade is a nylon cargo strapping net.

9. The removable barricade system of claim 8, wherein a removable connector is coupled to at least one extension loop.

10. The removable barricade of claim 1, wherein the predetermined condition is that a predetermined threshold force is not applied to the horizontal member.

11. The removable barricade of claim 1, wherein the adjustable tensioner is a buckle.

12. The removable barricade of claim 1, wherein the adjustable tensioner is a latch.

13. The removable barricade of claim 1, wherein at least one of the first, second, and third sleeves has one or more loops through which the horizontal member is threaded.

14. The removable barricade of claim 1, wherein the first, second, and third bollards are arranged substantially linearly, and wherein the second bollard is located between the first and third bollards and the horizontal member is mechanically coupled to the first and third sleeves.

15. The removable barricade of claim 1, wherein the horizontal member is mechanically coupled to the first sleeve.

16. A removable barricade system for use with a first, second, and third bollard comprising:

a first sleeve, second sleeve, and third sleeve affixed to the first bollard, second bollard, and third bollard respectively;

a flexible lateral member spanning the first, second, and third bollards and supported by the first, second, and third sleeves, the flexible lateral member forming a loop encircling the first, second, and third bollards; and an adjustable tensioner for tensioning the flexible lateral member and gathering an excess portion of the flexible lateral member provided a predetermined condition is met.

17. The removable barricade of claim 16, wherein at least one of the first, second, and third sleeves has one or more loops through which the flexible lateral member is threaded.

18. The removable barricade of claim 16, wherein the predetermined condition is that a predetermined threshold force is not applied to the flexible lateral member.

19. The removable barricade of claim 16, wherein the flexible lateral member is arranged in a loop around the first, second, and third bollards.

20. The removable barricade of claim 18, wherein the predetermined threshold force is the force applied by a vehicle striking the flexible lateral member.

21. A removable barricade system for use with a left, middle, and right bollard comprising:

a left sleeve, middle sleeve, and right sleeve affixed to the left bollard, middle bollard, and right bollard respectively;

a flexible lateral member spanning the left, middle, and right bollards and supported by the left, middle, and right sleeves, the flexible lateral member forming a loop encircling the first, second, and third bollards; and an adjustable tensioner for tensioning the flexible lateral member and gathering an excess portion of the flexible lateral member provided a predetermined condition is met.

22. The removable barricade of claim 21, wherein the predetermined condition is that a predetermined threshold force is not applied to the flexible lateral member.

23. The removable barricade of claim 22, wherein the predetermined threshold force is the force applied by a vehicle striking the flexible lateral member.

* * * * *